United States Patent [19]

Maenishi et al.

[11] Patent Number: 4,647,885

[45] Date of Patent: Mar. 3, 1987

[54] ELECTROMAGNETIC RELAY WITH DOUBLE SHEET SPRING ARMATURE SUPPORT

[75] Inventors: Kozo Maenishi, Nagaokakyo; Youichi Nakanishi, Kyoto, both of Japan

[73] Assignee: Omron Tateisi Electronics Co., Kyoto, Japan

[21] Appl. No.: 657,589

[22] Filed: Oct. 4, 1984

[30] Foreign Application Priority Data

Oct. 5, 1983 [JP] Japan ..... 58-187232

[51] Int. Cl.[4] ..... H01H 51/22

[52] U.S. Cl. ..... 335/78; 335/230; 335/274

[58] Field of Search ..... 335/78, 230, 274

[56] References Cited

U.S. PATENT DOCUMENTS 3,987,383 10/1976 Antonitsch ..... 335/78

*Primary Examiner*—L. T. Hix
*Assistant Examiner*—Brian W. Brown
*Attorney, Agent, or Firm*—Wegner & Bretschneider

[57] ABSTRACT

An electromagnetic relay includes an electromagnet, an armature assembly opposed to the electromagnet which moves according to the selective energization of the electromagnet, a contact mechanism which operates according to the movement of the armature assembly, and a pair of sheet springs which support the armature assembly so that it can reciprocate along its direction of motion. Thus, because the biasing force characteristic curve may be altered by altering the spring forces and characteristics of either or both of the sheet springs, it is possible to greatly expand the possible range and variety of adjustment of the relay, as opposed to the case in which only one sheet spring is used. The two sheet springs may optionally be mounted one on either side of the armature assembly, with respect to its direction of motion. And, optionally, a first one of the sheet springs is coupled to the armature assembly by its central portion and to a fixed member by its two end portions, while a second one of the sheet springs is coupled to the armature assembly by its two end portions and to a fixed member by its central portion. The fixing of the springs to the armature assembly and/or to the fixed members may either be loose, sliding, turning, or cantilever type; each has its benefits in terms of preventing wobbling of the armature assembly. The armature assembly may be provided with guide feet for keeping its motion rectilinear and orthogonal to the longitudinal direction of the electromagnet.

24 Claims, 20 Drawing Figures

ELECTROMAGNETIC RELAY WITH DOUBLE SHEET SPRING ARMATURE SUPPORT

BACKGROUND OF THE INVENTION

The present invention relates to an electromagnetic relay, and more particularly relates to an electromagnetic relay in which switch contacts are switched over by movement of an armature assembly in response to the energization of an electromagnet, in which it is practicable to obtain a good switching characteristic for the relay.

There is a known type of electromagnetic relay, comprising an electromagnet which may comprise an electromagnetic coil with an iron core, and a movable block equipped with an an armature which is positioned opposed to said electromagnet. The movable block is mounted so as to be reciprocable to and fro, according to the magnetization or demagnetization of the electromagnet, and contacts are provided which are opened and closed according to this reciprocal movement of said movable block. Thus, when the electromagnet is energized, the movable block is biased in a certain direction, and moves so as to open or close certain of the contacts. On the other hand, when the coil is energized in the electrical direction opposite to said particular direction, the movable block is biased in the opposite direction, and moves so as to close or open said certain of its contacts. (The position when the coil is not energized can be either of these positions or a position intermediate between them, depending on the biasing of the movable block). Thereby the contacts are reliably and positively switched, and a good and efficient relay is provided.

An important question that arises in the design and production of an electromagnetic relay is the importance of adjusting the biasing force characteristics of the armature assembly thereof. As schematically illustrated in FIG. 4 of the accompanying drawings, which shows various forces on the armature assembly along the vertical axis and the displacement of said armature assembly along the horizontal axis, it is desirable that, in all positions of the armature assembly, the biasing force on the armature should be between the actuation force on said armature assembly and the required restoring force for said armature assembly. In other words, the amount of force available for moving said armature, when the relay is actuated, should be greater than the biasing force on the armature assembly, so that the armature assembly can reliably be moved for actuation; while on the other hand this biasing force on the armature assembly should be greater than the required force for restoring the armature assembly, so that the armature assembly can reliably be restored to its original position, when so required. When this condition is considered for all positions of the armature assembly, we derive the condition that the biasing force curve for the armature assembly, illustrated by the curve (B) in FIG. 4, should fall between the actuation force curve, illustrated by the curve (A) in FIG. 4 and based on the voltage applied to the coil of the relay, and the required restoring force curve, illustrated by the curve (C) in FIG. 4. However, in the past the adjustment of the biasing force characteristic curve of an electromagnetic relay of this type has been performed by adjusting a single sheet spring which is used for restoring the armature, and this makes it difficult to rigorously adapt the biasing force characteristics of the armature to more rigorous requirements.

Furthermore, due to fluctuations in the mechanical characteristics of the parts inevitably caused by manufacturing tolerances, and due to assembly inaccuracies, the biasing force characteristic curve may depart from the desired one to some extent. In short, if only one sheet spring is used for restoring the position of the armature assembly then it is very difficult to properly fine adjust the operational characteristics of the relay.

Further, an important point is to prevent any woggling or swaying of the armature assembly during its motion, i.e. to preserve its self parallelism as it is reciprocated by selective energization of the electromagnet assembly. Such woggling or snaking motion of the armature assembly can cause some delay in the contact action thereof, and some unevenness in operational performance of the relay, and further can cause different portions of the contact assembly to come into contact with other different portions, thereby causing uncertain operation. In the case that the contact portions of the contact assembly are covered with or are made of a precious metal such as gold, either this will result in some non gold portions coming into mutual contact for electrical conduction, which will nullify the benefits of using gold at all and will mean that the resistance of the relay contacts is variable and unpredicable, or alternatively it will be necessary to use a larger quantity of the precious metal, which is expensive. Further, mutual sliding and mutual fretting can be caused between the relay contacts by such inclined or woggling motion of the armature assembly as it moves, and this can cause undue wear on these contacts. Especially, this swaying of the armature assembly can be caused by asymmetry in its biasing means, although in fact the armature assembly is not immune to swaying and canting if its biasing means is symmetrically arranged. Accordingly it is important to provide a sure and positive means for preventing swaying and canting of the armature assembly.

SUMMARY OF THE INVENTION.

Accordingly, it is the primary object of the present invention to provide an electromagnetic relay, whose operational characteristics can be conveniently and easily fine adjusted.

It is a further object of the present invention to provide such an electromagnetic relay, whose biasing force characteristics can be altered over a wide range and diversity of characteristic patterns.

It is a further object of the present invention to provide such an electromagnetic relay, in the adjustment of which fluctuations due to manufacturing tolerances and assembly inaccuracies can be compensated for.

It is a further object of the present invention to provide such an electromagnetic relay, which is reliable in service.

It is a further object of the present invention to provide such an electromagnetic relay, which can be manufactured so as to be consistent in its operational properties.

It is a further object of the present invention to provide such an electromagnetic relay, which can be manufactured easily and cheaply.

It is a further object of the present invention to provide such an electromagnetic relay, which is compact in size.

It is a further object of the present invention to provide such an electromagnetic relay, the contact portions of which are not liable to undue wear.

It is a further object of the present invention to provide such an electromagnetic relay, the contact portions of which are not liable to mutual fretting.

It is a further object of the present invention to provide such an electromagnetic relay, wherein the self parallelism of the armature assembly thereof, as it is reciprocated to and fro, is always well assured.

It is a further object of the present invention to provide such an electromagnetic relay, wherein it is prevented that the armature assembly thereof, as it is reciprocated to and fro, should wobble or sway.

It is a further object of the present invention to provide such an electromagnetic relay, which is not liable to any delay in the contact action thereof.

It is a further object of the present invention to provide such an electromagnetic relay, wherein it is prevented that the resistance of contact points thereof should vary unduly.

It is a further object of the present invention to provide such an electromagnetic relay, wherein no undue amount of precious metal is required for coating or fabricating the contact points thereof.

According to one aspect of the present invention, these and other objects are accomplished by an electromagnetic relay, comprising: an electromagnet; an armature assembly opposed to said electromagnet which moves according to the selective energization of said electromagnet; a contact mechanism which operates according to said movement of said armature assembly; and a pair of sheet springs which support said armature assembly so that it can reciprocate along its direction of motion.

According to such a structure, since the biasing force characteristic curve may be altered by altering the spring forces and characteristics of either or both of the sheet springs, it is possible to greatly expand the possible range and variety of adjustment of the electromagnetic relay, as opposed to the case in which only one support sheet spring is used. And thereby the operational characteristics of the relay can be conveniently and easily fine adjusted, and can be altered over a wide range and diversity of characteristic patterns. Thus, in the adjustment of this electromagnetic relay, fluctuations due to manufacturing tolerances and assembly inaccuracies can be compensated for. According to this construction, furthermore, this electromagnetic relay is reliable in service, and can be manufactured so as to be consistent in its operational properties. Also, this electromagnetic relay can be manufactured easily and cheaply, and is compact in size.

According to another aspect of the present invention, these and other objects are accomplished by an electromagnetic relay of the type defined above, wherein said two sheet springs are mounted one on either side of said armature assembly, with respect to its direction of motion.

According to such a structure, the armature assembly is particularly well and steadily held between the two sheet springs.

Further, these and other objects are accomplished by an electromagnetic relay of the type defined above, wherein a first one of said sheet springs is coupled to said armature assembly by its central portion and to a fixed member by its two end portions, while a second one of said sheet springs is coupled to said armature assembly by its two end portions and to a fixed member by its central portion. And further, said first one of said sheet springs may be loosely coupled to said armature assembly by its central portion; and further or alternatively may be loosely coupled to said fixed member by its two end portions. These possible arrangements help to ensure that, even when the forces of the spring portions on the two sides of said first one of said sheet springs differ somewhat, said first one of said sheet springs can shift according to this unbalance by its central portion or its two end portions shifting sideways, and thus even when the force exerted by said first one of said sheet springs is irregular or asymmetric between the right and the left sides the parallel orientation of the armature assembly to the electromagnet is maintained.

Further, these and other objects are accomplished by an electromagnetic relay of the type first described, wherein each of said sheet springs is coupled to one of said armature assembly and a fixed member by its central portion and to the other of said armature assembly and said fixed member by its two end portions; and said end portions of said two sheet springs may be coupled to the relevant members so that they cannot move and cannot rotate with respect to said members; or alternatively said end portions of said two sheet springs may be coupled to the relevant members so that they cannot move but can rotate with respect to said members.

According to such a construction, no play in the end engagement points of the sheet springs arises, since they are fixed either with regard to their position only and not with regard to their rotation, or alternatively with regard also to their rotation, and hence no inbalance between the spring forces of the two sheet springs can arise, and no swaying or woggling or canting of the armature assembly can arise, and its self parallelism is always assured, as it is reciprocated to and fro. Thereby, the contact portions of the relay are not liable to mutual fretting or to undue wear. Accordingly, there is provided an electromagnetic relay, which is not liable to any delay in the contact action thereof. Thus, the operational characteristics of the electromagnetic relay are well assured.

Further, these and other objects are accomplished by an electromagnetic relay of the type just described, wherein, during all of the movement of said armature assembly, a parallelogram is defined by: the point (a) of fixing of an end portion of one of said sheet springs; the point (b) of fixing of said central portion of said one of said sheet springs closest to said point (a); the point (c) of fixing of the opposite end portion of the other of said sheet springs; and the point (d) of fixing of said central portion of said other of said sheet springs closest to said point (c).

According to such a construction, no substantial tilting of the armature assembly, as it moves to and fro, can occur. This is a consequence of the fact that the alteration in the lengths of the free portions of the sheet springs, which are being bent, is minimal, and to a first approximation can be ignored. Therefore, as the above mentioned parallelogram shape is maintained, its two pairs of sides are always maintained mutually parallel as they move.

Further, these and other objects are accomplished by an electromagnetic relay of the type first described, wherein a one of said sheet springs, at a certain point in the travel of said armature assembly as it moves in a certain direction, comes into contact with a shoulder shape formed on said armature assembly; and, as said armature assembly further moves in said certain direction, said one of said sheet springs bends around its portion which is in contact with said shoulder shape.

According to such a construction, during the travel of said armature assembly as it moves in said certain direction, the effective coefficient of elasticity of said one of said sheet springs first has a first lower value before it has come into contact with said shoulder shape formed on said armature assembly, but, after said one of said sheet springs has come into contact with said shoulder shape formed on said armature assembly, its effective coefficient of elasticity has a second higher value. Accordingly, the operational characteristics of the restoring means for the armature assembly, including said two sheet springs, can be further advantageously and appropriately tailored, to be optimal.

Further, these and other objects are accomplished by an electromagnetic relay of the type first described, further comprising a guide member attached to said armature assembly and a fixed member formed with a guide shape with which said guide member cooperates to keep said armature assembly in its reciprocating path.

According to such a construction, the armature assembly is even more positively kept from swaying and woggling to and fro, and accordingly even more positively it is prevented that the mutual meeting portions of contact elements of the relay should shift. Accordingly, it is ensured that the resistance of the contact points of the relay will not vary unduly, and that therefore no undue amount of precious metal will be required for coating or fabricating these contact points.

Yet further, these and other objects are accomplished by an electromagnetic relay of the type described, wherein an end of one of said sheet springs is formed in a bifurcated shape, with one of its branches being thus coupled to said fixed member, and with its other branch being selectively pressed against said fixed member according to the flexing amount of said sheet spring.

According to such a structure, the operational characteristics of the electromagnetic relay can be even more desirably tailored, since the sheet spring has a different proportional constant of elasticity when said other branch is being pressed against said fixed member, from that in the case when said other branch is not being pressed against said fixed member. Thus, it is possible to desirably arrange that the biasing force characteristic for the armature assembly of the relay should properly fall between the actuation force characteristic and the restoring force characteristic, for all positions of said armature assembly, as will be described later in this specification.

BRIEF DESCRIPTION OF THE DRAWINGS

The present invention will now be shown and described with reference to the preferred embodiments thereof, and with reference to the illustrative drawings, which are all of them given purely for the purposes of explanation and exemplification only, and are not of them intended to be limitative of the scope of the present invention in any way. In the drawings, like parts and features are denoted by like reference symbols in FIGS. 1 through 6 thereof, and in FIGS. 7 through 18 thereof, and.

DESCRIPTION OF THE PREFERRED EMBODIMENTS

Figure 1:
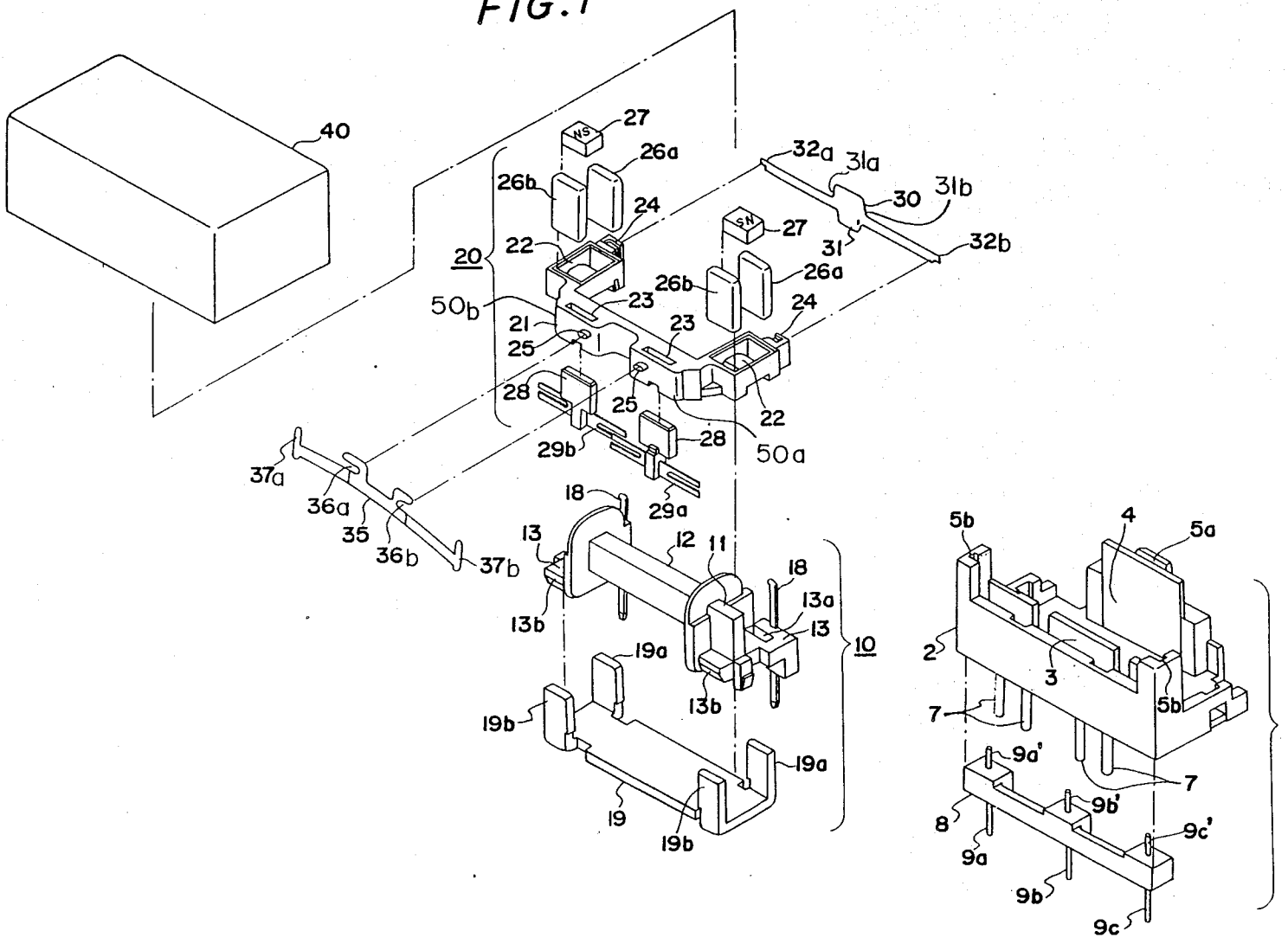
FIG. 1 is an exploded perspective view showing the detailed construction of a first preferred embodiment of the electromagnetic relay of the present invention.

The present invention will now be described with reference to the preferred embodiments thereof, and with reference to the appended drawings. FIG. 1 shows said first preferred embodiment of the relay of the present invention in an exploded view. This relay is structured as a high frequency relay, and is substantially made up of a base assembly 1 which includes a contact assembly, an electromagnet assembly 10, an armature assembly 20, a pair of restoring springs 30 and 35, and an outer case 40.

The base assembly 1 comprises a base 2 integrally molded from synthetic resin and a terminal platform 8. The base 2 has a rectangular slot 3 formed therein, and the terminal platform 8 is fixedly secured in this slot 3 and has fixed terminals 9*a*, 9*b*, and 9*c* mounted in it. Upper contact portions 9*a*′, 9*b*′, and 9*c*′ of the terminals 9*a*, 9*b*, and 9*c* lie in the slot 3, on the upper side of the base assembly 1 from the point of view of the figure, and in this slot 3 there are provided ground contacts 6*a* through 6*f* on the walls of the slot 3 adjacent to each of the upper contact portions 9*a*′, 9*b*′, and 9*c*′ of the terminals 9*a*, 9*b*, and 9*c* on either side thereof (see FIG. 2). Out from the bottom of the base 2 there project four ground terminals 7, and these ground terminals 7 and the ground contacts 6*a* through 6*f* are electrically connected together by a thin electroconductive film deposited on the surface of the base 2, such as a film of Cu-Ni alloy. Of course, this electroconductive film does not touch the fixed terminals 9*a*, 9*b*, and 9*c*.

Figure 2:
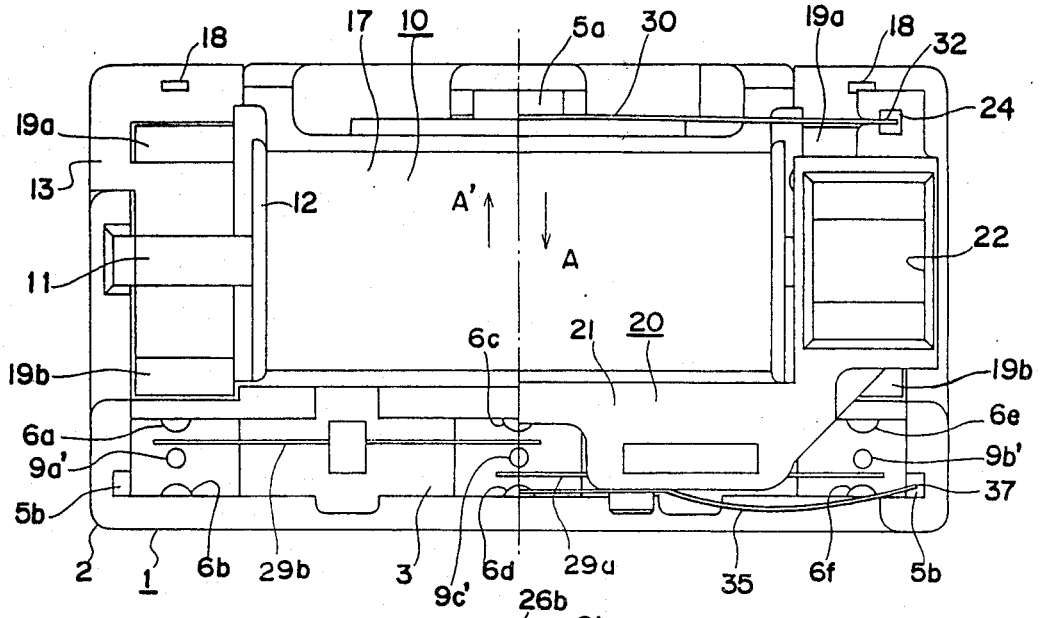
FIG. 2 is a plan view of the inside of said first preferred embodiment, with a cover and an armature assembly thereof being removed.
Figure 3:
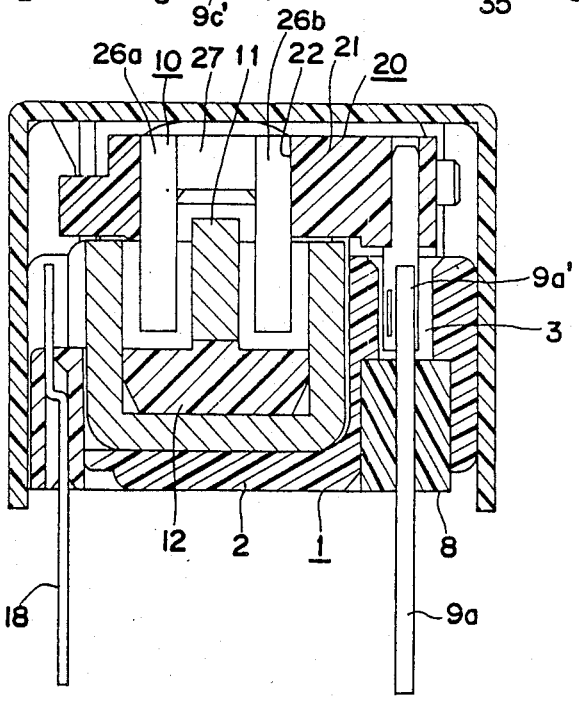
FIG. 3 is a sectional view of said first preferred embodiment, taken in a plane shown by the dot dashed line in FIG. 2 and perpendicular to the drawing paper thereof.

The electromagnet assembly 10 comprises a spool 12 through the middle of which there is fitted an iron core 11 and on which there is wound a coil 17, not shown in FIG. 1 but visible in FIG. 2. The spool 12 is connected to a yoke member 19, which has two upward projecting pole pieces 19*a* and 19*b* at each of its ends which are positioned on the two sides of the corresponding projecting end of the iron core 11. In detail, the connection between the spool 12 and the yoke member 19 is accomplished by platform members 13 being fitted on either end of the spool 12 and by the upward projecting pole pieces 19*a* being fitted through slots 13*a* in the platform members 13 while the inwardly facing side surfaces of the pole pieces 19*b* are contacted to the outwardly facing side surfaces of side portions 13*b* of the platform members 13. This electromagnet assembly 10 is fitted to the base 2 by being secured into a recess 4 thereof. And two coil terminals 18, 18, are fixedly mounted in the two platform members 13 and project downwards therefrom through appropriate holes in the base 2, not particularly shown, so that actuating electrical energy can be selectively supplied therethrough to the coil 17, the two ends of which are connected to said coil terminals 18, 18.

The armature assembly 20 comprises a body portion 21 which is integrally molded from synthetic resin, and at each end of this body portion 21 there are mounted in a frame portion 22 two plate pieces 26*a* and 26*b* and a permanent magnet 27 bridging between them so as to define a C-shape, with the orientations of the permanent magnets 27, 27 opposite to one another. Further, two insulated contact carrying members 28, 28 are fitted into slot shaped holes 23 formed in said body portion 21, and these two contact carrying members 28 carry respective springy contact pieces 29*a* and 29*b*, each of which is held by its said contact carrying member 28 by its central portion and extends on both sides of said central portion with free springy leaves. The armature assembly 20 is so disposed that, at each of its ends, the plate pieces 26*a* and 26*b* are inserted into the aforementioned gaps defined between the end of the iron core 11 and the pole pieces 19*a* and 19*b*, with some lateral movement still being available therebetween. And the armature assembly 20 is held in this position by two sheet springs 30 and 35, which will shortly be described, in such a fashion as to be movable to and fro transversely relative to the longitudinal axis of said armature assembly 20 and of the electromagnet assembly 10, against a restoring force provided by these sheet springs 30 and 35, through a certain distance in the directions A and A′ (see FIG. 2). And, as will be seen, during this transverse motion, the armature assembly 20 remains oriented with its longitudinal axis substantially parallel to that of the electromagnet assembly 10, and does not sway or wobble, but moves always substantially parallel to itself.

Figure 5:
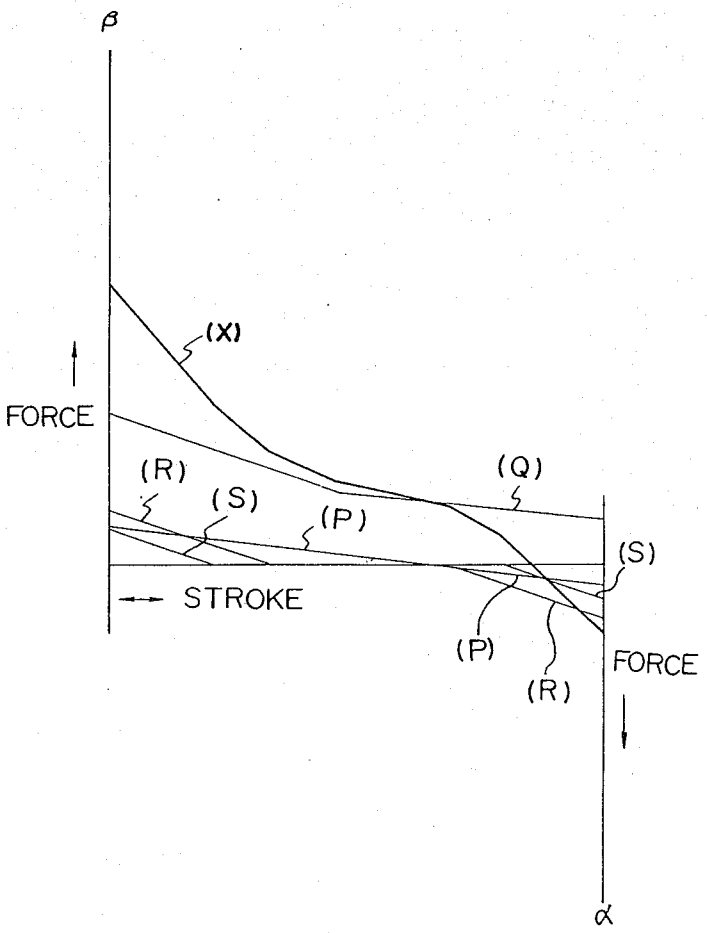
FIG. 5 is a graph, in which also the stroke of said armature assembly is shown along the horizontal axis and force is shown along the vertical axis, illustrating the actual switching characteristics of the first preferred embodiment relay of FIGS. 1, 2, and 3.

In this first preferred embodiment of the present invention, the first sheet spring 30 is fixed to the base 2 by its central portion 31 (which has two outer portions 31*a* and 31*b*) being fitted into a slot 5*a* formed in said base 2, and its end portions 32*a*, 32*b* are fitted into slots 24 formed in the body portion 21 of the armature assembly 20. On the other hand, the sheet spring 35 is fixed to the armature assembly 20 by hooked or notched shape portions 36*a*, 36*b* at its center portion (whose notch shapes extend in either direction along the longitudinal direction of said sheet spring 35) being loosely fitted over corresponding projections 25 formed on the body portion 21 of said armature assembly 20, and its end portions 37*a*, 37*b* are fitted into slots 5*b* formed in the base 2. The spring forces of the sheet springs 30 and 35 are given by the lines (P) and (Q) respectively in FIG. 5, which is a graph showing stroke of the armature assembly 20 against the forces applied thereto: the graph of the spring force of the spring 30 is a straight line (P), and the graph of the spring force of the spring 35 is a straight line (Q) bent in the middle thereof. The reason for this line (Q) to be bent in the middle is that, when the armature assembly 20 is moved in the A′ direction as seen in FIG. 2 from the central point of its travel, then the sheet spring 35 bends from its middle portion secured by the ears 36*a*, 36*b* formed thereon to the body portion 21 of said armature assembly 20, to its ends; but, on the other hand, when the armature assembly 20 is moved in the A direction as seen in FIG. 2 from the central point of its travel, then the sheet spring 35 bends from its end only to intermediate portions thereof which become abutted against shoulder shapes 50*a*, 50*b* formed on said body portion 21 of said armature assembly 20, and accordingly has a higher effective coefficient of elasticity. The right hand base line alpha in FIG. 5 shows the situation when the armature assembly 20 is fully displaced in the A′ direction, while conversely the left hand base line beta shows the situation when it is fully displaced in the A direction.

Specifically, when the electromagnetic coil 17 is de-energized, then, since in this preferred embodiment the iron core 11 of the electromagnet assembly 10 is magnetized, an attractive force exists between the two end surfaces of the iron core 11 and the two respective plate pieces 26*b*, 26*b*, while a repulsive force exists between said end surfaces of the iron core 11 and the other two respective plate pieces 26*a*, 26*a*, and hence the armature assembly 20 moves in the direction of the arrow A′ in FIG. 2, so that the two ends of the springy contact piece 29*a* contact the contacts 9*b*′ and 9*c*′, while the two ends of the springy contact piece 29*b* contact the ground contacts 6*a* and 6*c* and bend somewhat while doing so. On the other hand, when the electromagnetic coil 17 is energized, then an attractive force exists between the two end surfaces of the iron core 11 and the two respective plate pieces 26*a*, 26*a*, while a repulsive force exists between said end surfaces of the iron core 11 and the other two respective plate pieces 26*b*, 26*b*, and hence the armature assembly 20 moves in the direction of the arrow A in FIG. 2, so that the two ends of the springy contact piece 29*b* contact the contacts 9*a*′ and 9*c*′, while the two ends of the springy contact piece 29*a* contact the ground contacts 6*d* and 6*f* and bend somewhat while doing so.

Figure 4:
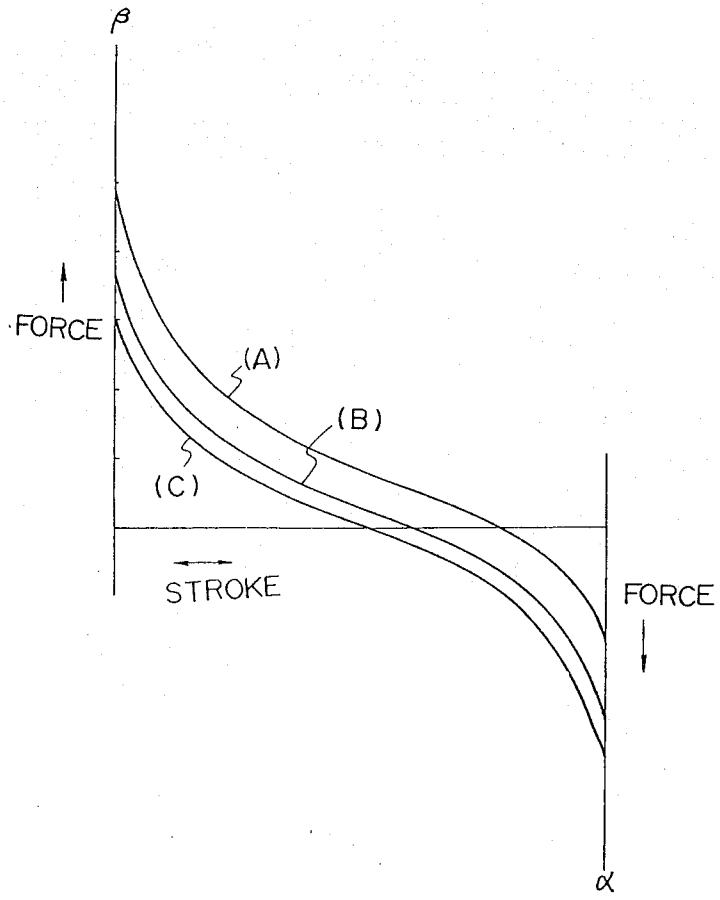
FIG. 4 is a graph, in which the stroke of the armature assembly is shown along the horizontal axis and force is shown along the vertical axis, illustrating the ideal switching characteristics for an idealized relay.

In other words, in this first preferred embodiment, the armature assembly 20 moves to and fro in the directions of the arrows A and A′ according to the energization or non energization of the coil 17, and switches the contacts 9*a*′ and 9*c*′, and 9*b*′ and 9*c*′. The overall biasing force curve is defined by the curve (X) in FIG. 2, being made up by combining the curves (P) and (Q) representing the spring forces of the springs 30 and 35 and the curves (R) and (S) representing the spring forces exerted by the elasticity of the springy contact pieces 29*a* and 29*b*. This resultant biasing force curve (X) is so shaped as to conveniently fall, as does the ideal biasing force curve (B) illustrated in FIG. 4 for an idealized relay, between the actuation force curve (A) and the required restoring force curve (C).

In detail, the adjustment of the biasing force curve (X) of this relay can be made by adjusting the characteristics of the sheet springs 30 and 35, which are based on their bending angles. As seen from FIG. 5, the graph (P) of the spring force of the sheet spring 30 is effectively a straight line, and adjustment of the strength of this spring has the effect of moving the biasing force curve (X) up and down. On the other hand, the graph (Q) of the spring force of the sheet spring 35 is effectively a straight line bent at the middle of the stroke of the armature assembly 20, and adjustment of the strength of this spring has the effect of determining the inclination angle of the biasing force curve (X). And hence by adjusting the characteristics of these springs 30 and 35 the characteristics of the relay can be set to be very suitable.

Since the sheet spring 35 is only loosely coupled to the armature assembly 20 by its central hooked or ear portions 36*a*, 36*b* being loosely fitted over the projections 25 on said body portion 21, and also because its end portions 37*a*, 37*b* are loosely or slidingly fitted into the slots 5*b* formed in the base member 2, even when the forces of the spring portions on the two sides of said spring 35 differ somewhat, the spring 35 can shift according to this unbalance by the hooked or notched portions 36*a*, 36*b* shifting sideways on the projections 25, and thus even when the force exerted by the sheet spring 35 is irregular or asymmetric between the right and the left sides the parallel orientation of the armature assembly 20 to the coil 17 and the core 11 is maintained.

Next, a second preferred embodiment of the relay of the present invention will be discussed. Because this second preferred embodiment is very similar to the first preferred embodiment, just described, only the portions thereof which differ from said first preferred embodiment will be described, and no particular figures representing the structure of this second preferred embodiment will be shown, but only FIG. 6 which illustrates its operation in schematic plan view will be discussed.

This relay has sheet springs 30 and 35 like those of the first preferred embodiment discussed above, and as in the case of said first preferred embodiment the first sheet spring 30 is fixed to the base 2 by its central portion 31 with the two outer portions 31*a* and 31*b* being fitted into a slot 5*a* formed in said base 2, and its end portions 32*a*, 32*b* are fitted into slots 24 formed in the body portion 21 of the armature assembly 20, while on the other hand the sheet spring 35 is fixed to the armature assembly 20 by hooked or notched shape portions 36*a*, 36*b* at its center portion whose notch shapes extend in either direction along the longitudinal direction of said sheet spring 35 being fitted over corresponding projections 25 formed on the body portion 21 of said armature assembly 20, while its end portions 37*a*, 37*b* are fitted into slots 5*b* formed in the base 2. On the other hand, in this second preferred embodiment, when the first sheet spring 30 is being fixed to the base 2 by its central portion 31, adhesive is applied thereto, so that the two outer portions 31*a* and 31*b* of said first sheet spring 30 are securely adhered to the ends of the slot 5*a* formed in said base 2, thus ensuring that these points of the first sheet spring 30 are fixed with respect to the base 2 and cannot either move or rotate with respect thereto. And also, when said first sheet spring 30 is being fixed to the armature assembly 20 with its end portions 32*a*, 32*b* being fitted into the slots 24 formed in the body portion 21 of said armature assembly 20, again adhesive is applied thereto, so that said two end portions 32*a*, 32*b* are securely fixed to said slots 24, thus ensuring that these points of the first sheet spring 30 are fixed with respect to the armature assembly 20 and cannot either move or rotate with respect thereto.

Figure 6:
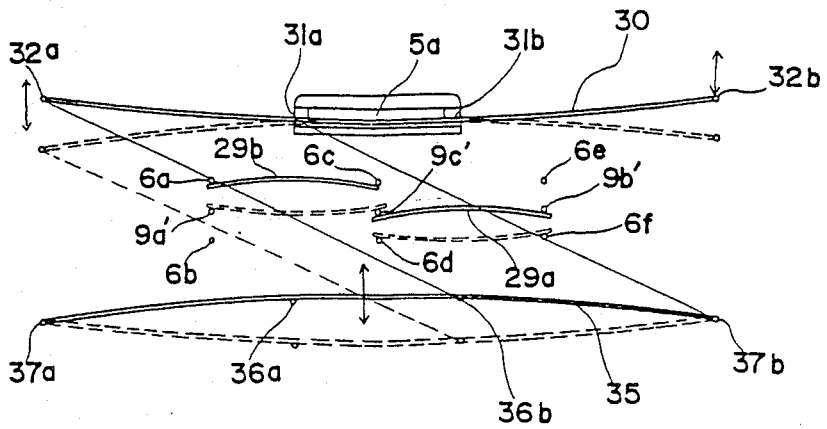
FIG. 6 illustrates in schematic plan view the operation of an essential portion of the second preferred embodiment of the relay of the present invention.

Further, when the second sheet spring 35 is being fixed to the armature assembly 20 by its central portion 35 and the ears 36*a* and 36*b*, the projecting pin portions 25 of the armature body portion 21 are crimped over, so that the ears 36*a*, 36*b* of said second sheet spring 35 are securely adhered to a longitudinally central part of said armature assembly 20, thus ensuring that these points of the second sheet spring 35 are fixed with respect to the armature assembly 20 and cannot either move or rotate with respect thereto. And also, when said first sheet spring 35 is being fixed to the base 2 with its end portions 37*a*, 37*b* being fitted into the slots 5*b* formed in said base 2, again adhesive is applied thereto, so that said two end portions 37*a*, 37*b* are securely fixed to said base 2, thus ensuring that these points of the second sheet spring 35 are fixed with respect to the base 2 and cannot either move or rotate with respect thereto. By these positive fixings it is ensured, as illustrated in FIG. 6, that, whatever may be the position of the armature assembly 20 in its travel as the sheet springs 30 and 35 move and are bent to and fro, the points shown in that figure as 32*a*, 31*a*, 37*b*, and 36*b* always define a parallelogram; and similarly the four points shown in that figure as 31*b*, 32*b*, 36*a*, and 37*a* also always define a parallelogram. In other words, the point 31*a* at which the inner end of the left part of the first sheet spring 30 is fixed to the base 2 which is a point which is fixed with respect to the base 2, the point 32*a* at which the outer end of said left part of said first sheet spring 30 is fixed with respect to the armature assembly 20 which is a point which is fixed with respect to said armature assembly 20, the point 37*b* at which the outer end of the right part of the second sheet spring 35 is fixed to the base 2 which is a point which is fixed with respect to the base 2, and the point 36*b* at which the inner end of said right part of said second sheet spring 35 is fixed with respect to the armature assembly 20 which is a point which is fixed with respect to said armature assembly 20, all outline and define a parallelogram; and similarly the point 31*b* at which the inner end of the right part of the first sheet spring 30 is fixed to the base 2 which is a point which is fixed with respect to the base 2, the point 32*b* at which the outer end of said right part of said first sheet spring 30 is fixed with respect to the armature assembly 20 which is a point which is fixed with respect to said armature assembly 20, the point 37*a* at which the outer end of the left part of the second sheet spring 35 is fixed to the base 2 which is a point which is fixed with respect to the base 2, and the point 36*a* at which the inner end of said left part of said second sheet spring 35 is fixed with respect to the armature assembly 20 which is a point which is fixed with respect to said armature assembly 20, all outline and define another parallelogram.

By this particular structure of fixedly securing the ends and also the central portions of the sheet springs 30 and 35 to the base 2 and to the body member 21 of the armature assembly 20, it is ensured that no looseness of the construction can occur, and accordingly no difference can arise in the spans of the arm portions of these sheet springs. Accordingly, the spring forces on the left and the right sides of the armature assembly 20 always are even, and no possibility arises that the armature assembly 20 should lose its parallel attitude to the electromagnet assembly 10, as it reciprocates transversely to the direction of their longitudinal axes.

Further, because the points 32*a*, 31*a*, 37*b*, and 36*b* as defined above and in FIG. 6 always define a parallelogram, and similarly the four points shown in that figure as 31*b*, 32*b*, 36*a*, and 37*a* also always define a parallelogram, thereby even more the self parallelism of the armature assembly 20 is ensured, as it reciprocates to and fro. This ensures that time lag is eliminated from the action of the contacts 9*a*', 9*b*', and 9*c*', and accordingly the operational properties of the electromagnetic relay may be improved. Further, since the points of the movable contact pieces 28, 28 which contact the fixed contacts 9*a*', 9*b*', and 9*c*' do not alter, since the self parallelism of the armature assembly 20 is assured, and accordingly no sideways slipping of the movable contact pieces 28, 28 against these fixed contacts 9*a*', 9*b*', and 9*c*' can occur, the durability of all these contact pieces is enhanced.

Now, the good effects outlined above would be possible to be made available if the ends and/or the central portions of the sheet springs were fixed so as to be rotatable, rather than being fixed both with regard to movement and with regard to rotation as was the case in the shown second preferred embodiment. This concept should thus be understood to be within the scope of the present invention, as a specialization thereof. Further, the two sheet springs need not be straight, as in the shown preferred embodiments, but may have bent portions angled to either side.

Also, although in the shown second preferred embodiment of the present invention the sheet springs 30 and 35 were shown as configured with one of them (the sheet spring 30) fixed to the base 2 at the midpart 31 of said sheet spring 30 and fixed to the armature assembly 20 at its two end portions 32*a* and 32*b*, while in the contrary construction the other sheet spring (the sheet spring 35) was fixed to the armature assembly 20 at the midparts 36*a*, 36*b* of said sheet spring 35 and was fixed to the base 2 at its two end portions 37*a* and 37*b*, this opposed form of construction is not essential to the present invention, and it would be possible as an alternative for both of the sheet springs to be fitted in the same manner as one another, so that, for example, both of them were fixed to the armature assembly by their central portions, and were fixed to the base 2 by their end portions. The contrary construction, in which both of the sheet springs are fixed to the armature assembly by their end portions, and are fixed to the base 2 by their central portions, is also conceivable, and is likewise within the ambit of the present invention.

Figure 7:
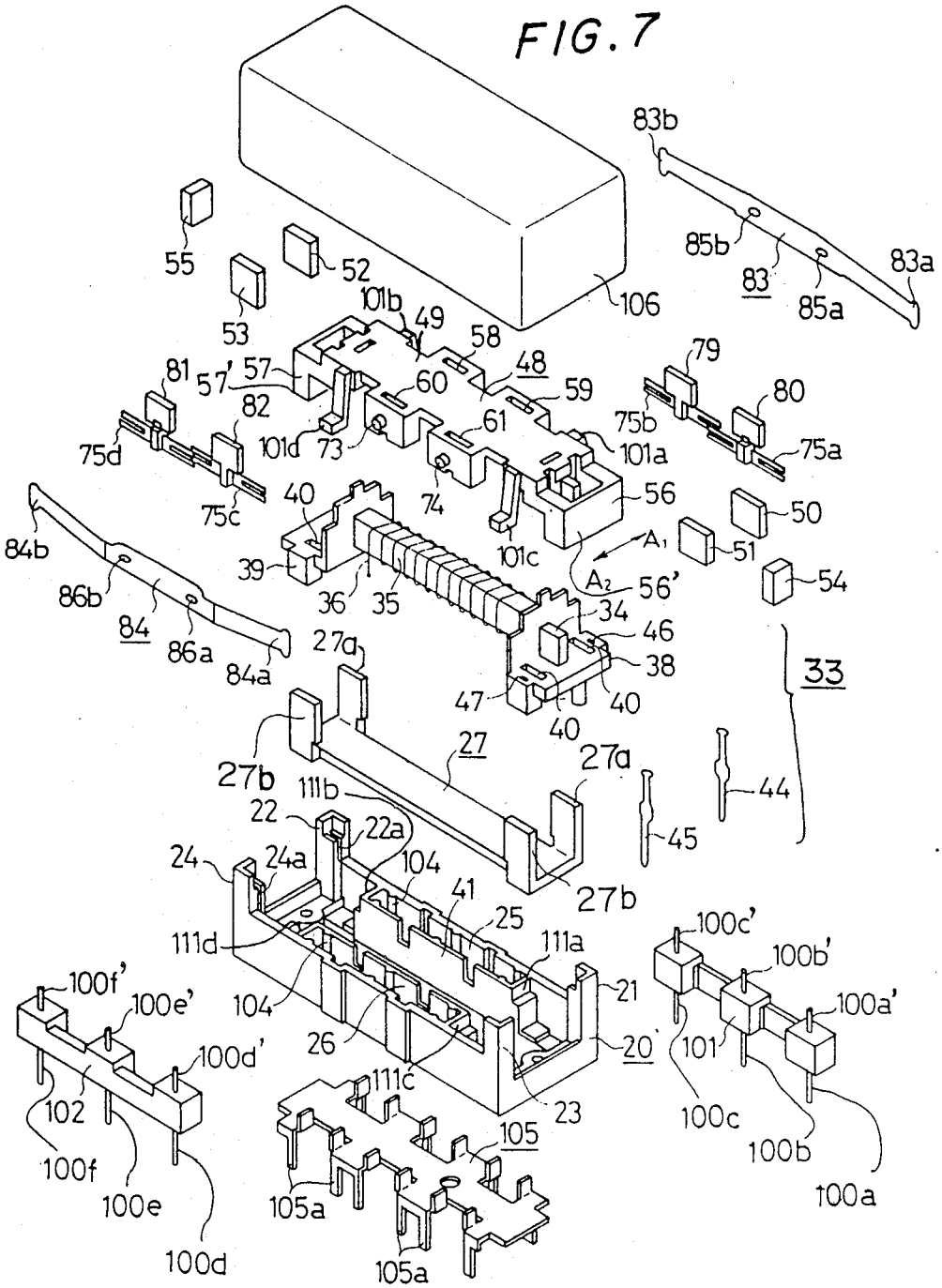
FIG. 7 is an exploded perspective view, similar to FIG. 1 relating to the first preferred embodiment, showing the detailed construction of a third preferred embodiment of the electromagnetic relay of the present invention, which is distinguished in that an armature assembly thereof has feet members.

Now, in FIGS. 7, 8, 9, and 10, there is shown a third preferred embodiment of the relay of the present invention. FIG. 7 shows said third preferred embodiment of the relay of the present invention in an exploded view. This relay is structured as a high frequency relay, and is substantially made up of a base assembly which includes a contact assembly, an electromagnet assembly 33, an armature assembly 48, a pair of restoring springs 83 and 84, and an outer case 106.

The base assembly comprises a base 21 integrally molded from synthetic resin and two terminal platforms 101 and 102. The base 21 has four column members 21, 22, 23, and 24 erected at its four corners, and also has two rectangular slots 25 and 26 formed therein, and the terminal platforms 101 and 102 are fixedly secured in these slots 101 and 102 and respectively have fixed terminals 100*a*, 100*b*, and 100*c* and 100*d*, 100*e*, and 100*f* mounted in them. Upper contact portions 100*a*', 100*b*', and 100*c*' of the terminals 100*a*, 100*b*, 100*c* lie in the slot 25, and upper contact portions 100*d*', 100*e*', and 100*f*' of the terminals 100*d*, 100*e*, and 100*f* lie in the slot 26, on the upper side of the base assembly from the point of view of the figure.

The electromagnet assembly 33 comprises a spool 35 through the middle of which there is fitted an iron core 34 and on which there is wound a coil 36. The spool 35 is connected to a yoke member 27, which has two upward projecting pole pieces 27*a* and 27*b* at each of its ends which are positioned on the two sides of the corresponding projecting end of the iron core 34. In detail, the connection between the spool 35 and the yoke member 27 is accomplished by platform members 38, 39 being fitted on either end of the spool 35 and by the upward projecting pole pieces 27*a* and 27*b* being fitted through slots 40 in the platform members 38, 39. This electromagnet assembly 33 is fitted to the base 21 of the base assembly by being secured into a recess 41 thereof between the slot shaped chambers 25 and 26, by being held therein by the platform members 38 and 39. And two coil terminals 44 and 45 are fixedly mounted in the platform member 38 and project downwards therefrom through appropriate holes in the base 20, not particularly shown, so that actuating electrical energy can be selectively supplied therethrough to the coil 36, the two ends of which are connected to said coil terminals 44, 45.

The armature assembly 48 comprises a body portion 49 which is integrally molded from synthetic resin, and at each end of this body portion 49 there are mounted in a corresponding one of frame portions 56, 57 two plate pieces 50, 51 or 52, 53 and a permanent magnet 54, 55 bridging between them so as to define a C-shape, with the orientations of the permanent magnets 54, 55 opposite to one another. Further, four insulated contact carrying members 79, 80, 81, and 82 are fitted into slot shaped holes 58, 59, 60, and 61 formed in said body portion 49, two on each of its sides, and these four contact carrying members 79, 80, 81, and 82 carry respective springy contact pieces 75*a*, 75*b*, 75*c*, and 75*d*, each of which is held by its corresponding contact carrying member by its central portion and extends on both sides of said central portion with free springy leaves. The armature assembly 48 is so disposed that, at each of its ends, the plate pieces 50, 51 or 52, 53 are inserted into the aforementioned gaps defined between the end of the iron core 34 and the pole pieces 27*a* and 27*b*, with some lateral movement still being available therebetween. And the armature assembly 48 is held in this position by two sheet springs 83 and 84, which will shortly be described, in such a fashion as to be movable to and fro transversely relative to the longitudinal axis of said armature assembly 48 and of the electromagnet assembly 33, against a restoring force provided by these sheet springs 83 and 84, through a certain distance in the directions A1 and A2 (see FIG. 8).

Now, a distinguishing feature of this third preferred embodiment of the present invention is that the frame portions 56, 57 of the armature assembly 48 have foot portions 56', 57' the lower ends in the figure of which slide on the upper surfaces of the respective ones of the the platform members 38 and 39 of the electromagnet assembly 33, and also the body portion 49 of said armature assembly 48 is provided with four other foot members 101*a*, 101*b*, 101*c*, and 101*d* the lower ends in the figure of which slide in guide grooves respectively defined by side walls 111*a*, 111*b*, 111*c*, and 111*d* of the base 20 of the relay. Thereby, the armature assembly 48 is positively and definitely kept oriented with its longitudinal axis substantially parallel to that of the electromagnet assembly 33, so that, even more surely than in the first or the second preferred embodiments described above, it positively cannot sway or wobble, but moves always substantially parallel to itself.

In this third preferred embodiment, the first sheet spring 83 is fixed to the body portion 49 of the armature assembly 48 by its central portion having two holes 85*a* and 85*b* formed in it, and by crimping pieces 71 and 72 (see FIG. 9) on said body portion 49 being fitted through these holes 85*a* and 85*b* and being crimped over as for example by heating. And the end portions 83*a*, 83*b* of this first sheet spring 83 are fitted into slots 21*a* and 22*a* respectively formed in the pillar pieces 21 and 22 of the base 20. Similarly, in this third preferred embodiment, the other or second sheet spring 84 is fixed to the armature assembly 48 by its central portion having two holes 86*a* and 86*b* formed in it, and by crimping pieces 74 and 73 on said body portion 49 being respectively fitted through these holes 86*a* and 86*b* and similarly being crimped over as for example by heating. And the end portions 84*a*, 84*b* of this second sheet spring 84 are fitted into slots 23*a* and 24*a* respectively formed in the pillar pieces 23 and 24 of the base 20. And, as shown in FIG. 9, the sheet springs 83 and 84 are curved and bent so as to exert a biasing force on the armature assembly 48 in the direction shown by the arrows A1 in FIGS. 8 and 9.

Figure 8:
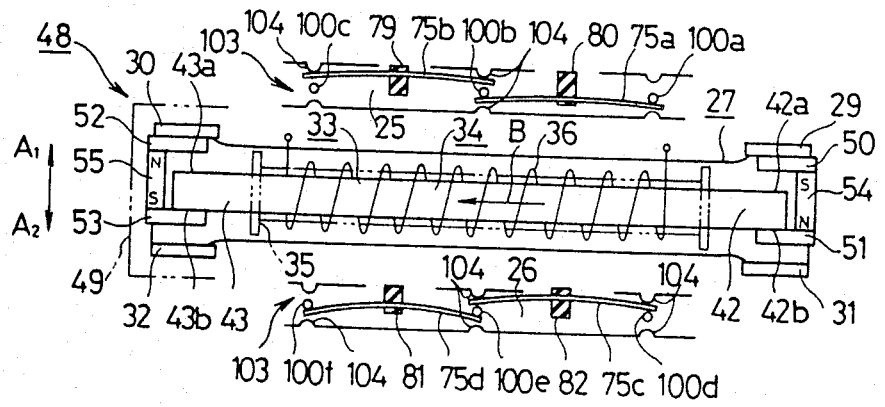
FIG. 8 is a schematic plan view of the inside of said third preferred embodiment, with a cover thereof being removed and the armature assembly not being shown.
Figure 9:
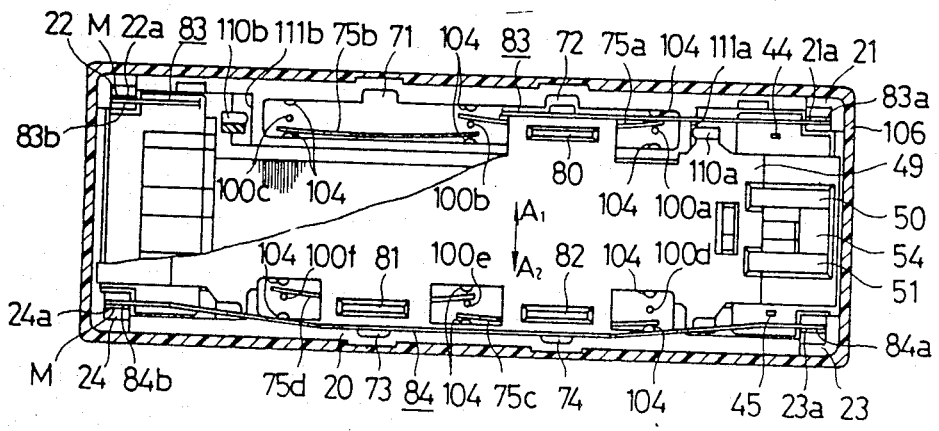
FIG. 9 is another schematic plan view of the inside of said third preferred embodiment, similar to FIG. 2 relating to the first preferred embodiment, with said cover thereof being removed and with most of the armature assembly being shown but with a portion thereof broken away.
Figure 10:
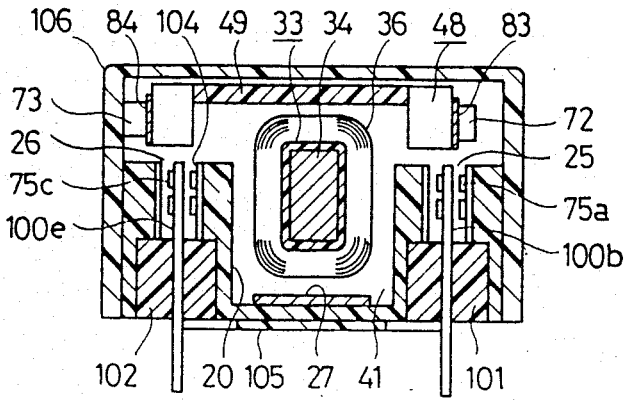
FIG. 10 is a vertical sectional view of said third preferred embodiment, similar to FIG. 3 relating to the first preferred embodiment, taken in a plane perpendicular to the drawing paper of FIG. 9.

As shown in FIGS. 8 through 10, the movable contact pieces 75*a*, 75*b* are inserted into the slot shaped chamber 25 so as to confront the fixed contact members 100*a*, 100*b*, and 100*c*; and, similarly, the other two movable contact pieces 75*c*, 75*d* are inserted into the slot shaped chamber 26 so as to confront the fixed contact members 100*d*, 100*e*, and 100*f*. As the armature assembly 48 is moved to and fro, then these contact pieces alternately connect these terminals to one another, or disconnect them from one another, in a fashion which will be explained shortly. Ground contacts 104 are provided in the chambers 25 and 26 in positions opposed to positions on the outer sides of the movable contact pieces 75*a* to 75*d*. And 105 is a ground plate having ground terminals 105*a* disposed between the fixed contact members 100*a* through 100*f* outside the relay below the insulators 101 and 102, and this ground plate 105 is attached to the lower surface in FIG. 7 of the base 20, as may be seen in FIG. 10. In fact, both the base 20 and this ground plate 105 may be made of a synthetic resin and may be covered with a metallic electroconductive film (not shown in the figure) formed by such a means as plating, vapor deposition, or painting. Thereby the ground terminals 105*e* shown in FIG. 7 are electrically connected to the ground contacts 104 in the chambers 25 and 26.

This third preferred embodiment operates as follows.

When the electromagnetic coil 36 is deenergized, then the armature assembly 48 moves in the direction of the arrow A1 in FIGS. 7, 8 and 9 under the biasing action of the springs 83 and 84, so that, in the chamber 25, the two ends of the springy contact piece 75*a* contact the contacts 100*a'* and 100*b'*, while the two ends of the other springy contact piece 75*b* contact the ground contact 104. And, in the other chamber 26, the two ends of the springy contact piece 75*d* contact the contacts 100*e'* and 100*f'*, while the two ends of the other springy contact piece 75*c* contact the ground contact 104. In this operational state, the armature pieces 50, 52 on the one side of the armature assembly 48 are being attracted to the contact pieces 27*a* on the one side of the electromagnet assembly 33, and the other armature pieces 51, 53 are being attracted to the side surfaces of the iron core 34 of the electromagnet assembly 33. And the magnetic flux due to the permanent magnets 54, 55 is flowing in the iron core 34 in the direction indicated by the arrow B in FIG. 8.

On the other hand, when the electromagnetic coil 36 is energized, thereby canceling the magnetic flux of the permanent magnets in this state, then the armatures 50, 52 are attracted to the contact pieces 27*b* on the other side of the electromagnet assembly 33, and the armature assembly 48 moves in the direction of the arrow A2 in FIGS. 7, 8 and 9, against the biasing action of the springs 83 and 84 which is overcome. In this state, in the chamber 25, the two ends of the springy contact piece 75*a* move away from the contacts 100*a'* and 100*b'* and while the two ends of the other springy contact piece 75*b* now contact the contacts 100*b'* and 100*c'*. And, in the other chamber 26, the two ends of the springy contact piece 75*c* now contact the contacts 100*d'* and 100*e'*, while the two ends of the other springy contact piece 75*d* now move away from the contacts 100*e'* and 100*f'* and contact the ground contact 104. In other words, in this third preferred embodiment, the armature assembly 48 moves to and fro in the directions of the arrows A1 and A2 according to the energization or non energization of the coil 36, and switches the contacts 100'a through 100f' as specified above. Accordingly good relay action is available.

Because the guide pieces or legs 101a to 101d projectingly provided from the body portion 49 of the armature assembly 48 slidingly engage with the grooves formed in the base 20 defined by the guide walls 111a to 111d during the reciprocating motion of the armature assembly 48, swinging or canting of said armature assembly is positively prevented, thereby making it possible to make the movable contact pieces 75a to 75d impact against the fixed contact pieces 100'a to 100'f always at fixed points and providing the advantages that the contact resistance is small and free from fluctuation and the wear of the contact points is minimized.

Further, because, when the movable contact pieces 75a to 75d are moved away from the corresponding fixed contact pieces 100a' to 100f' during the switching action as described above, the movable contact pieces 75a to 75d contact the ground contact points 104 covered with an electroconductive film, and the chambers 25, 26 of the base 20 are shielded by this electroconductive film, there is no risk of causing an electrostatic connection between the fixed contact pieces 100a' to 100f' by way of the movable contact pieces 75a to 75d when the movable contact pieces 75a to 75d and the fixed contact pieces 100a' to 100f' are moved apart, which might otherwise cause high frequency short circuiting. The ground terminal 105a shown in FIG. 1 has the function of preventing the leakage of high frequency current between the neighboring fixed terminals 100a to 100f in the insulators 101, 102.

Further, it would in principle be possible to use only one of the four guide pieces or legs 101a to 101d. In this case, as a matter of course it would suffice if the guide wall relating thereto should contacts on both sides of this single guide piece.

Particularly according to this third preferred embodiment, because the guide pieces or legs 101a to 101d projectingly provided from the body portion 49 of the armature assembly 48 are made of synthetic resin integral with the body portion 49, and the guide walls 111a to 111d formed in the base 20 are covered by a metallic electroconductive film, the sliding between the metallic guide walls 111a to 111d and the synthetic resin guide pieces or legs 101a to 101d is made very amicably due to the existence of the metallic electroconductive film, with the result that there is little risk of the metallic electroconductive film peeling off and the resulting metallic powder infiltrating between the fixed contact pieces 100a' to 100f' and the movable contact pieces 75a to 75d to cause some faulty contact.

As seen in FIG. 9, the one ends 83b, 84b which serve as support points with respect to a certain direction for the pair of sheet springs 83, 84 which are arranged so as to bias the armature assembly 48 along the direction of its motion are in this third preferred embodiment fixedly secured to the slits 22a, 22b of the base 20 with an adhesive agent M. In this case, because the guide pieces 110a to 110d projectingly provided from the body portion 49 of the armature assembly 48 are slidingly engaged to the guide walls 111a to 111d formed in the base 20, although the other ends 83a, 84a may undergo a rotative motion with the one ends 83b, 84b of the sheet springs 83, 84 in the one longitudinal direction of the armature assembly 48 (transverse to its direction of reciprocation) being held in a cantilever manner and neither being allowed to move nor to rotate, the swinging or canting motion of the armature assembly 48 is prevented. It is also possible to fixedly secure both the ends 83a, 83b (84a, 84b) of both of the sheet springs 83, 84, whereby even when the sheet springs 83, 84 make a snaking or wriggling motion, the canting or woggling motion of the armature assembly 48 is prevented by the guide means incorporating the legs 101a to 101d. However, as a matter of course, the driving force for the armature assembly 48 will be increased in this case.

Figure 11:
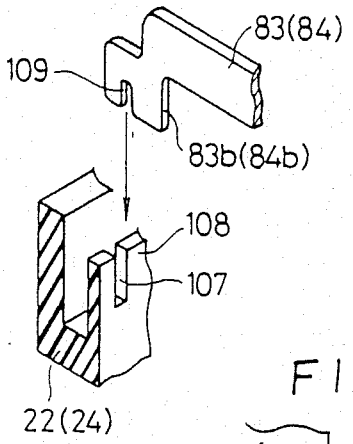
FIG. 11 is a perspective view of an essential portion of a fourth preferred embodiment of the electromagnetic relay of the present invention.
Figure 12:
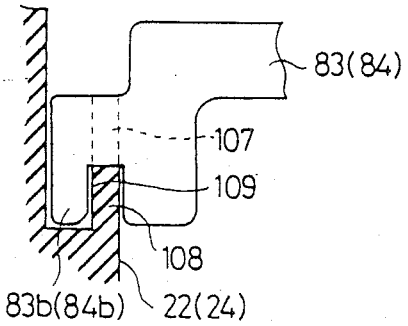
FIG. 12 is a side elevational view of said essential portion of said fourth preferred embodiment.
Figure 13:
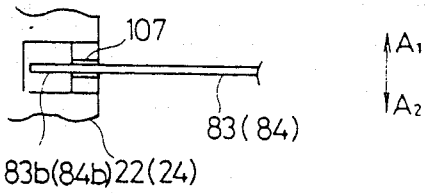
FIG. 13 is a plan view of said essential portion of said fourth preferred embodiment.
Figure 14:
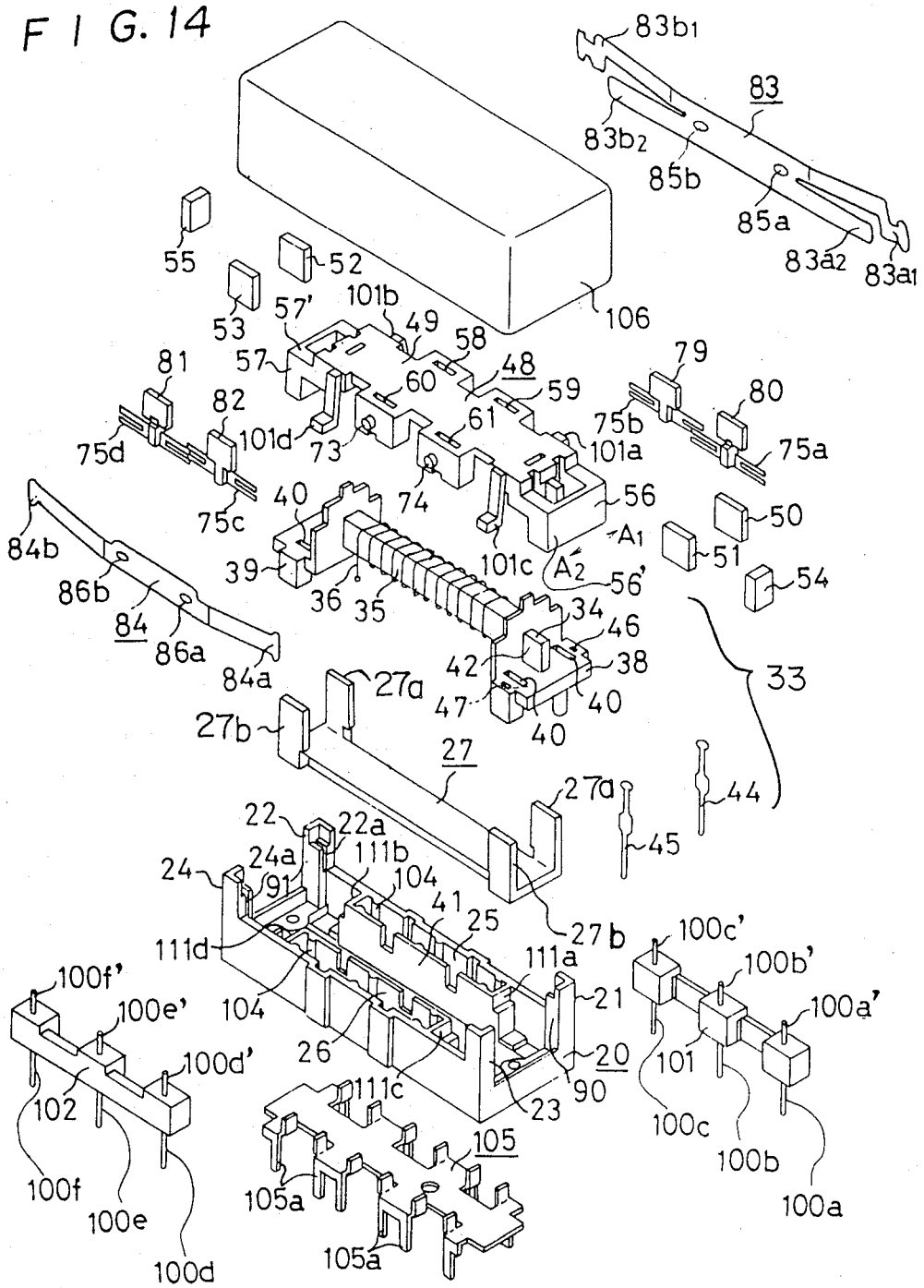
FIG. 14 is an exploded perspective view, similar to FIGS. 1 and 7 relating to the first and third preferred embodiments, showing the detailed construction of a fifth preferred embodiment of the electromagnetic relay of the present invention, which is distinguished in that an spring thereof is bifurcated.
Figure 15:
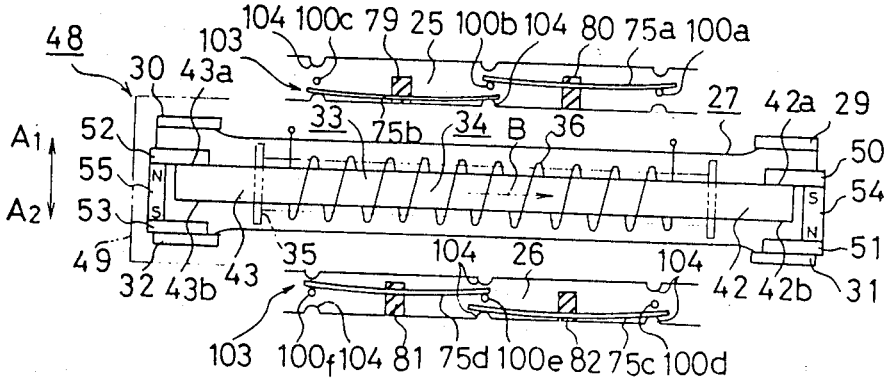
FIG. 15 is a schematic plan view, similar to FIG. 8 relating to the third preferred embodiment, of the inside of said fifth preferred embodiment, with a cover thereof being removed and the armature assembly not being shown.
Figure 16:
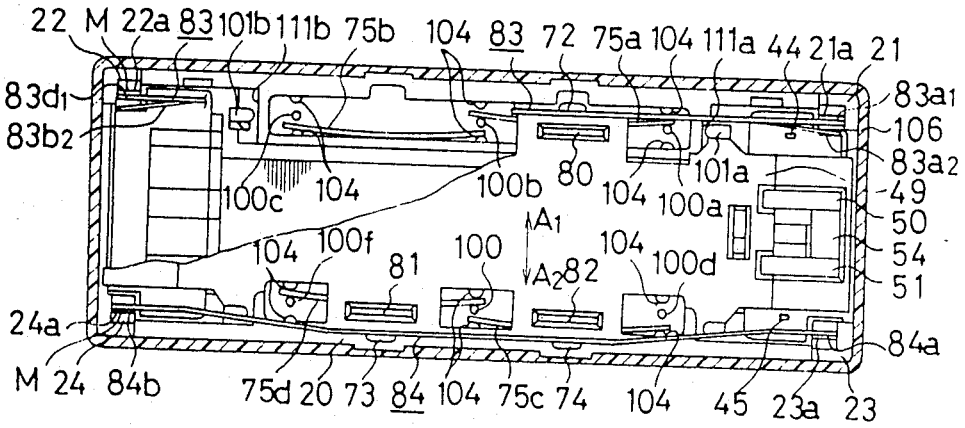
FIG. 16 is another schematic plan view of the inside of said fifth preferred embodiment, similar to FIGS. 2 and 9 relating to the first and third preferred embodiments, with said cover thereof being removed and with most of the armature assembly being shown but with a portion thereof broken away.
Figure 17:
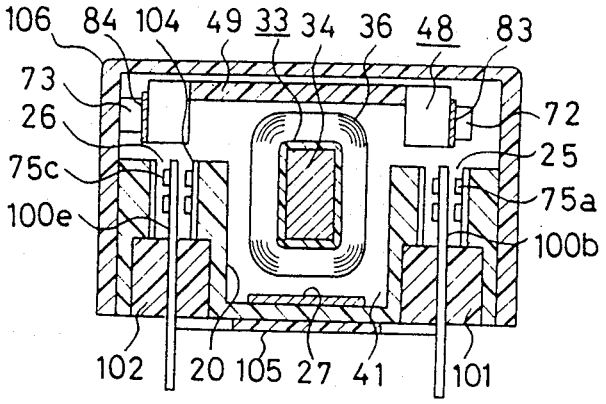
FIG. 17 is a vertical sectional view of said fifth preferred embodiment, similar to FIGS. 3 and 10 relating to the first and third preferred embodiments, taken in a plane perpendicular to the drawing paper of FIG. 19.

Alternatively, in a fourth possible preferred embodiment of the present invention, as shown in FIGS. 11, 12, and 13, it would be possible to fix the ends 83b, 84b in the one direction of the two springs 83, 84 to the base 20 in a pivotable fashion, i.e. so that they can be rotated but cannot be moved in a translatory fashion. A convenient construction for doing this is shown in perpective view in FIG. 11, in elevation in FIG. 12, and in plan view in FIG. 13: each end 83b, 84b of the springs 83, 84 is formed with a notch 109 facing downwards, and the corresponding portion of the pillar or column piece 22 or 24 respectively is formed with an upward facing notch 107 in a wall portion 108. Thereby, as will be easily understood based upon this description, the one ends 83b, 84b in the one direction of the two springs 83, 84 are pivotally held, to be rotatable relative to the base 20 about vertical axes as seen in FIG. 7, while their other ends are restrained in a slidable manner as shown in FIG. 9 etc.. Accordingly, again, the swinging or canting motion of the armature assembly 48 is prevented.

In the third and the fourth preferred embodiments of the present invention, it is considered to be preferable for the lengths from the ends 83b, 84b of the sheet springs 83, 84 to the fixed points of these sheet springs 83, 84 to the armature assembly 48, i.e. to or the crimping pieces 71, 73, to be the same, and for the distance between the two ends 83b and 84b of the sheet springs 83, 84 to be the same as the spacing between said crimping pieces 71, 73. This will ensure that the figure defined by these ends 83b, 84b and these crimping pieces 71, 73 really is a parallelogram, and thus the advantages explained earlier will ensue. I.e., according to such a structure, because both the springs 83, 84 will have the same bending angle, the armature assembly 48 can reciprocate as indicated by the arrow A1, A2 always in a parallel attitude. Therefore, no out of balance load will act between the movable contact pieces 75a to 75d and the fixed contact pieces 100a to 100f. Further, in FIG. 9, when the armature assembly 48 moves along the direction indicated by the arrows A1 and A2 in a parallel manner, also in fact this armature assembly 48 moves perpendicularly to this direction by a very small amount, and therefore wiping of the fixed contact pieces 100a to 100f and of the ground terminal 104 may be achieved.

Figure 18:
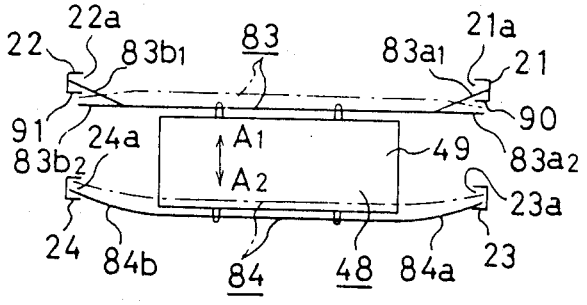
FIG. 18 is a schematic plan view for explaining the operation of said fifth preferred embodiment.

In FIGS. 14 through 17, a fifth and last preferred embodiment of the relay of the present invention is shown, in a fashion similar to FIGS. 7 through 10 with respect to the third preferred embodiment. The only difference between this fifth preferred embodiment and the third preferred embodiment described previously is that bifurcated pieces 83a1, 83a2, and 83b1, 83b2 are formed on the ends 83a and 83b of the sheet spring 83, and the longer ones 83a1, 83b1 of the bifurcated pieces on the two ends 83a and 83b are inserted into the slits 21*a*, 22*a* of the pillar pieces 21, 22 directed from the base 20, as shown in FIG. 18 which is a diagrammatical plan view, and the shorter ones 83*a*2, 83*b*2 of these bifurcated pieces on the two ends 83*a* and 83*b* are selectively sometimes contacted to the projections 90, 91 on the side walls of the pillar pieces 21, 22 respectively, so that the body portion 49 of the armature assembly 48 is basically biased by the bifurcated pieces 83*a*1, 83*b*1, while the other bifurcated pieces 83*a*2, 83*b*2 selectively sometimes further exert a further biasing spring force on the body portion 49 of the armature assembly 48 when, and only when, these bifurcated pieces 83*a*2, 83*b*2 contact the projections 90, 91 on the side walls of the pillar pieces 21, 22. Apart from this feature, this fifth preferred embodiment of the present invention is constructed quite the same as the third preferred embodiment described above, and accordingly further description will be eschewed in the interests of laconicism.

Now, during the operation of this relay, the armature assembly 48 is pressed in the A2 direction by the sheet spring 84 and the movable contact piece 75*a*contacts the common fixed contact piece 100*b*′ and the fixed contact 100*a*′ of the normally closed side while the movable contact piece 75*b* contacts the ground contact point 104 in the chamber 25. And the other movable contact piece 75*c* contacts the ground terminal 104 in the chamber 26 while the movable contact piece 75*d* contacts the common fixed contact piece 100*e*′ and the fixed contact piece 100*f*′ on the normally closed side. The armatures 51, 53 on one side of the movable armature assembly 48 are attracted to the contact pieces 27*b*, 27*b* on one side of the iron core frame 27, while the other armatures 50, 52 are attracted to the side surfaces of the ends of the iron core 34, whereby the magnetic flux of the permanent magnets 54, 55 flows in the iron core 34 in the B direction.

When the electromagnetic coil 36 is energized to produce a magnetic flux which cancels the magnetic flux of the permanent magnets, in this state, the armatures 50, 52 are attracted to the contact pieces 27*a*, 27*a* of the iron core frame 27, while the armatures 51, 53 are attracted to the side surfaces of the ends of the iron core 34. In other words, the movable armature assembly 48 moves in the direction which is orthogonal to the lengthwise direction of the iron core 34 against the spring forces exerted by the sheet springs 83, 84. As a result, the movable contact piece 75*a* is moved away from the fixed contact pieces 100*a*′, 100*b*′ and contacts the ground contact point 104, while the movable contact piece 75*b* contacts the fixed contact pieces 100*b*′, 100*c*′. And the movable contact piece 75*c* contacts the fixed contact pieces 100*d*′, 100*e*′ while the movable contact 75*d* moves away from the fixed contact pieces 100*e*′, 100*f*′ and contacts the ground contact point 104. In other words, a non conductive state is established between the fixed contacts 100*a*′, 100*b*′ and between 100*e*′, 100*f*′, while a conductive state is established between the fixed contacts 100*b*′ and 100*c*′ and between 100*d*′ and 100*e*′.

When the electromagnetic coil 36 is demagnetized, the body portion 49 of the armature assembly 48 is driven in the A2 direction by the spring force of the sheet springs 83, 84 and the state of the parts is restored, thereby achieving a conductive state between the fixed contact pieces 100*a*′, 100*b*′ and between 100*e*′ and 100*f*′, while a non conductive state is established between the fixed contact pieces 100*b*′, 100*c*′ and between 100*d*′ and 100*e*′.

Figure 20:
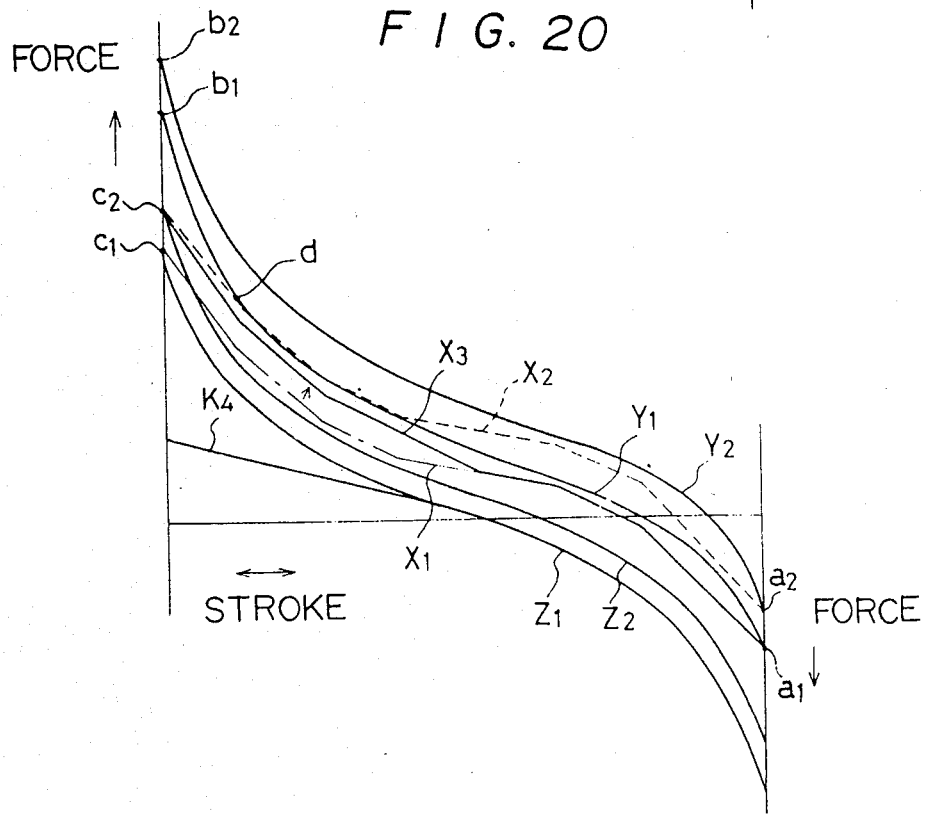
FIG. 20 is a graph, in which the stroke of the armature assembly is shown along the horizontal axis and force is shown along the vertical axis, illustrating the switching characteristics of the fifth preferred embodiment relay of FIGS. 14 through 17.

In such a series of actions, as shown in FIG. 20—which is a graph, similar to FIG. 5 relating to the first preferred embodiment, showing the stroke of the armature assembly 48 along the horizontal axis and showing force along the vertical axis, illustrating the actual switching characteristics of the fifth preferred embodiment relay of FIGS. 14 through 17—a load a1 acts on the movable armature assembly 48 due to the sheet springs 83, 84 in the A2 direction. Therefore, in order to drive the movable armature assembly 48 in the A1 direction, an operational voltage of a characteristic which yields force of a characteristic Y1 which is always higher than the load characteristic X1 is applied to the armature 48, thereby overcoming the load a1.

As the operational voltage rises, the armature assembly 48 moves in the A1 direction, and when the other bifurcated pieces 83*a*2, 83*b*2 contact the projections 90, 91 as shown schematically in FIG. 18, the spring force of the sheet spring 83 rises from a transition point m. In other words, while the spring force of either one of the bifurcated pieces 83*a*1, 83*b*1 is of characteristic K1 as shown in FIG. 19, the spring force of the sheet spring 83 as a whole rises as shown by the characteristic K3 from the transition point m as shown in FIG. 19 due to the additional force K2 which is generated when the bifurcated pieces 83*a*2, 83*b*2 contact the projections 90, 91 as shown in FIG. 18, and start to be bent.

Figure 19:
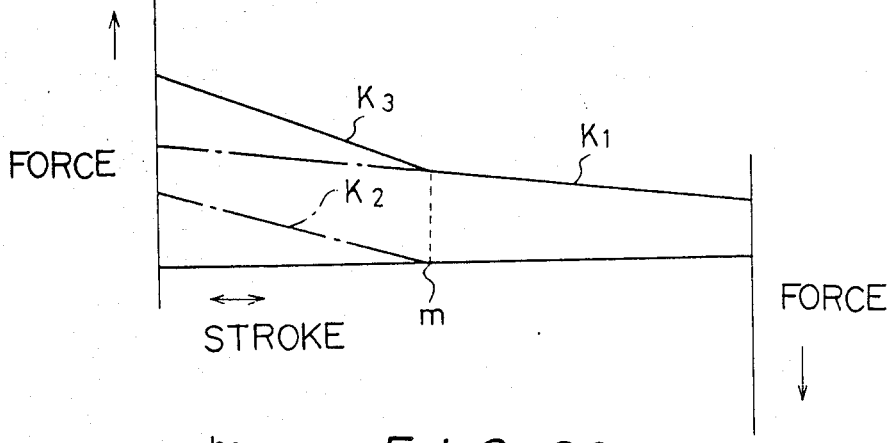
FIG. 19 is a graph, in which deflection is shown along the horizontal axis and spring force is shown along the vertical axis, showing the operational characteristics of a spring in said fifth preferred embodiment.

Therefore, if the force due to the bifurcated pieces 83*a*2, 83*b*2 of the sheet spring 83 and the sheet spring 83 itself is set up as characteristic X1 which is per se conventional, as shown in FIG. 20, because the force characteristic of the sheet spring 83 changes into K4 as shown in FIG. 19 due to the force K3 which is generated when the bifurcated pieces 83*a*2, 83*b*2 contact the projections 90, 91 as shown in FIG. 18, it becomes possible, without changing the operational voltage A1, to raise the spring force of the restoration voltage side from C1 to C2.

Therefore, when restoring the movable armature assembly 48 in the A2 direction, by reducing the restoration voltage below that necessary to produce the force C2, the restoration voltage becomes always lower than the force characteristic X1, as indicated by characteristic Z2, thereby producing a restoration voltage characteristic Z2 which is higher than the conventional restoration voltage characteristic Z1.

This can be further extended as follows. For instance, when the operational voltage characteristic Y2 is reduced to Y1 because Y2 is too high relative to the force X3, it is possible to adjust the operational voltage characteristic Y2 to Y1 with the restoration voltage characteristic Z2 fixed.

Thus, by supporting the bifurcated pieces 83*a*2, 83*b*2 and contacting the bifurcated pieces 83*a*1, 83*b*1 to the projections 90, 91 of the base 20 in a selectively detachable manner, the transition point m for the spring force may be made to correspond to the position at which the bifurcated pieces 83*a*1, 83*b*1 contact the projections 90, 91 of the base 20 as described in connection with FIG. 19, and the spring force characteristic may be fixed free from the influence of how the one ends of the sheet springs 83 and 84 are bent, where the crimping pieces fixedly secure the sheet springs, and so on.

Although the present invention has been shown and described with reference to the preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

What is claimed is:

1. An electromagnetic relay comprising:

an electromagnet, an armature assembly opposed to said electromagnet, a contact mechanism adjacent to said armature assembly, a base assembly supporting said armature assembly, and a pair of sheet springs which engage the armature assembly and the base assembly, wherein the armature assembly moves in reciprocating motion according to the selective energization of said electromagnet and said contact mechanism opens and closes according to the movement of said armature assembly.

2. An electromagnetic relay according to claim 1, wherein said two sheet springs are mounted one on either side of said armature assembly, with respect to its direction of motion.

3. An electromagnetic relay according to claim 1, wherein a first one of said sheet springs is coupled to said armature assembly by its central portion and to said base assembly by its two end portions, while a second one of said sheet springs is coupled to said armature assembly by its two end portions and to said base assembly by its central portion.

4. An electromagnetic relay according to claim 3, wherein said first one of said sheet springs is loosely coupled to said armature assembly by its central portion.

5. An electromagnetic relay according to claim 4, wherein said central portion of said first one of said sheet springs is formed with a notched shape, and said armature assembly is formed with a projection; said notched shape being hooked over said projection.

6. An electromagnetic relay according to claim 5, wherein said notched shape extends along the longitudinal direction of said first one of said sheet springs.

7. An electromagnetic relay according to claim 3, wherein said first one of said sheet springs is loosely coupled to said base assembly by its two end portions.

8. An electromagnetic relay according to claim 4, wherein said first one of said sheet springs is loosely coupled to said base assembly by its two end portions.

9. An electromagnetic relay according to claim 1, wherein a first one of said sheet springs is coupled to said armature assembly by its central portion and said base assembly by its two end portions, and a second one of said sheet springs also is coupled to said armature assembly by its central portion and to a fixed member by its two end portions.

10. An electromagnetic relay according to claim 1, wherein a first one of said sheet springs is coupled to said armature assembly by its two end portions and to a base assembly by its central portion, and a second one of said sheet springs also is coupled to said armature assembly by its two end portions and to a base assembly by its central portion.

11. An electromagnetic relay according to claim 1, wherein each of said sheet springs is coupled to one of said armature assembly or said base assembly by its central portion and to the other said armature assembly or said base assembly its two end portions.

12. An electromagnetic relay according to claim 11, wherein said end portions of said two sheet springs are coupled to the relevant members so that they cannot move and cannot rotate with respect to said members.

13. An electromagnetic relay according to claim 11, wherein said end portions of said two sheet springs are coupled so that they cannot move translationally but can rotate with respect to said members.

14. An electromagnetic relay according to claim 11, wherein, during all of the movement of said armature assembly, a parallelogram is defined by: the point (a) of fixing of an end portion of one of said sheet springs; the point (b) of fixing of said central portion of said one of said sheet springs closest to said point (a); the point (c) of fixing of the opposite end portion of the other of said sheet springs; and the point (d) of fixing of said central portion of said other of said sheet springs closest to said point (c).

15. An electromagnetic relay according to claim 1, wherein a one of said sheet springs, at a certain point in the travel of said armature assembly as it moves in a certain direction, comes into contact with a shoulder shape formed on said armature assembly; and, as said armature assembly further moves in said certain direction, said one of said sheet springs bends around its portion which is in contact with said shoulder shape.

16. An electromagnetic relay according to claim 1, further comprising a guide member attached to said armature assembly and a base assembly formed with a guide shape with which said guide member cooperates to keep said armature assembly in its reciprocating path.

17. An electromagnetic relay according to claim 1, further comprising a plurality of guide members attached to said armature assembly on both sides thereof and a base assembly formed with a plurality of guide shapes with which said guide members cooperate to keep said armature assembly in its reciprocating path.

18. An electromagnetic relay according to claim 16, wherein said guide member is formed of synthetic resin, and said base assembly is also formed of synthetic resin coated with metallic film.

19. An electromagnetic relay according to claim 9, wherein the end portions in a one direction of said two sheet springs are coupled to said base assembly that they cannot move with respect to said, base assembly while the end portions in the other direction of said two sheet springs are loosely coupled to said fixed member.

20. An electromagnetic relay according to claim 9, wherein the end portions in a one direction of said two sheet springs are coupled to said base assembly that they cannot move translationally but can rotate with respect to said base assembly, while the end portions in the other direction of said two sheet springs are loosely coupled to said base assembly.

21. An electromagnetic relay according to claim 19, wherein said coupling of said end portions in said one direction of said two sheet springs to said base assembly is done by adhesive.

22. An electromagnetic relay according to claim 9, wherein the distance between the base coupling points in a one direction of said two sheet springs to said base assembly is substantially equal to the distance between the closest armature coupling points to said base coupling points of said two sheet springs to said armature assembly, and also the distances between said base coupling points and their corresponding said armature coupling points on the relevant said sheet spring are substantially equal.

23. An electromagnetic relay according to claim 9, whererin an end of one of said sheet springs is formed in a bifurcated shape, with one of its branches being thus coupled to said fixed member, and with its other branch being selectively pressed against said base assembly according to the flexing amount of said sheet spring.

24. An electromagnetic relay according to claim 9, wherein each of the two ends of one of said sheet springs are formed in a bifurcated shape, with one of the branches being thus coupled to said base assembly, and with the other branch being selectively pressed against said base assembly according to the flexing amount of said sheet spring.

* * * * *